United States Patent [19]

Wunner

[11] Patent Number: 4,823,563

[45] Date of Patent: Apr. 25, 1989

[54] WARP KNITTING MACHINE WITH PILE INSTRUMENT BAR

[75] Inventor: Roland Wunner, Schwarzenbach, Fed. Rep. of Germany

[73] Assignee: Liba Maschinenfabrik GmbH, Naila, Fed. Rep. of Germany

[21] Appl. No.: 95,827

[22] Filed: Sep. 10, 1987

[30] Foreign Application Priority Data

Sep. 10, 1986 [DE] Fed. Rep. of Germany ..... 3630821

[51] Int. Cl.[4] ..... D04B 23/06

[52] U.S. Cl. ..... 66/84 R; 66/203

[58] Field of Search ..... 66/84 R, 84 A, 203

[56] References Cited

U.S. PATENT DOCUMENTS

| | | | |
|---|---|---|---|
| 3,857,260 | 12/1974 | Zwingenberger et al. | 66/84 R |
| 3,864,943 | 2/1975 | Wunner | 66/84 A |
| 4,003,222 | 1/1977 | Wunner | 66/84 R |

FOREIGN PATENT DOCUMENTS

| | | | |
|---|---|---|---|
| 2055374 | 5/1972 | Fed. Rep. of Germany | 66/84 R |
| 2124215 | 11/1972 | Fed. Rep. of Germany | 66/84 R |
| 334582 | 9/1930 | United Kingdom . | |
| 1284937 | 8/1972 | United Kingdom . | |
| 1486264 | 9/1977 | United Kingdom . | |
| 1509926 | 5/1978 | United Kingdom . | |
| 2027757 | 2/1980 | United Kingdom . | |
| 2053982 | 2/1981 | United Kingdom . | |

*Primary Examiner*—Ronald Feldbaum

*Attorney, Agent, or Firm*—Dority & Manning

[57] ABSTRACT

A warp knitting machine has several guide bars (15), which are suspended over the needles (1) from a bridge-like cross-beam (26) and has pile forming instruments (11) on a pile instrument bar (12). The latter is offset from the beam (26) and arranged below the guide bar operating zone. In this way the fabric can be knitted with pile loops according to a pattern.

7 Claims, 1 Drawing Sheet

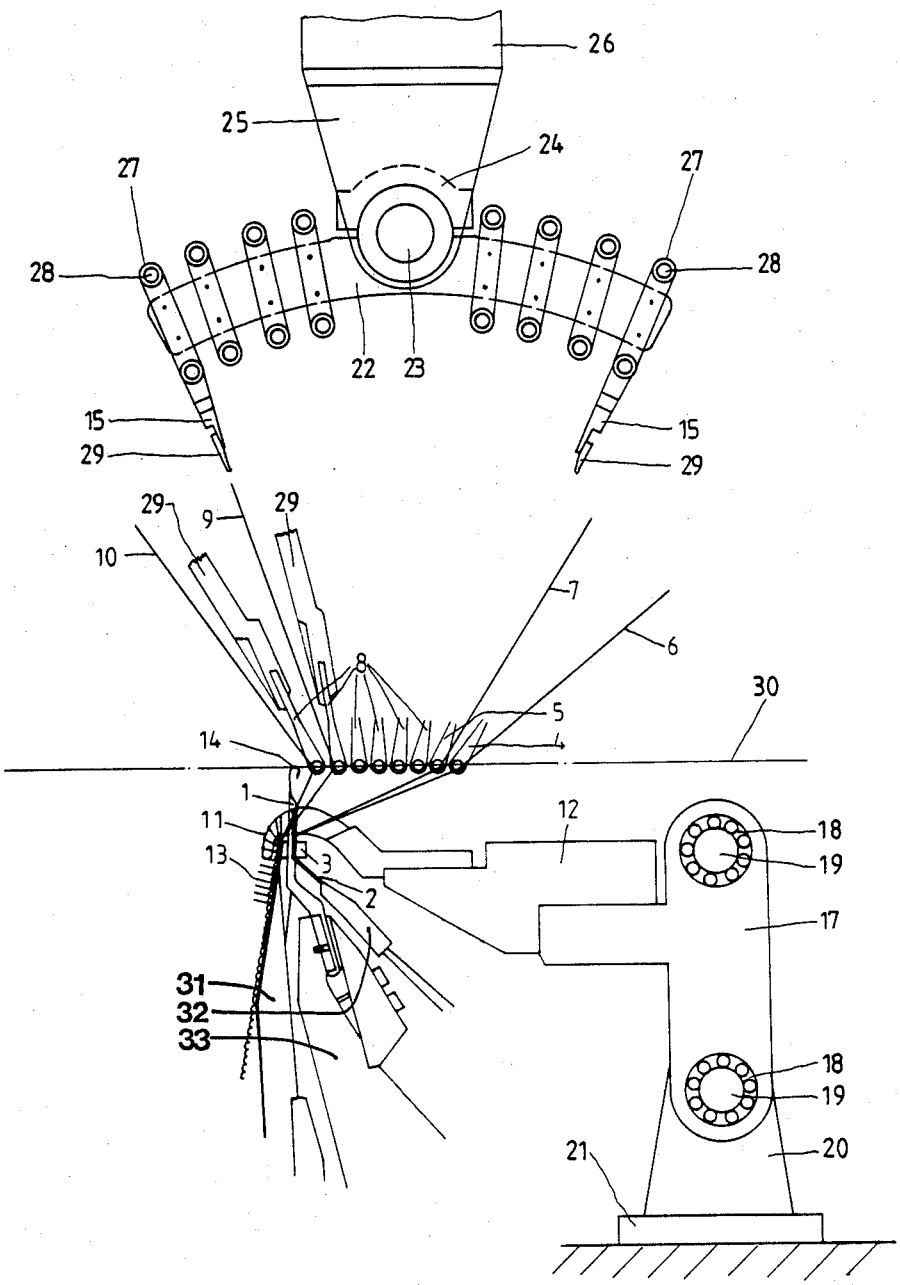
26
25
24
27
27
28
28
22
23
15
15
29
29
29
9
29
10
7
6
8
5
30
14
4
1
11
12
18
13
3
19
2
17
31
32
33
18
19
21
20

WARP KNITTING MACHINE WITH PILE INSTRUMENT BAR

BACKGROUND OF THE INVENTION

The invention relates to warp knitting machines for knitting pile fabric and in particular to such machines having, apart from several guide bars, also a pile instrument bar with pile forming instruments. The guide bars may be mounted on a bridge-like crossbeam.

DE-AS No. 2435312 discloses a warp knitting machine having two rows of guides with guide openings at their extremity and a pile instrument bar. Both guide bars and the pile instrument bar are arranged above the remainder of the knitting elements. Such a warp knitting machine is shown schematically from the side in the RACOP-POL brochure of LIBA-Textilmaschinen GmbH with three guide bars and one pile instrument bar. These bars are mounted by a transverse beam formed by a rectangular hollow member, extending parallel to and above the needle array transversely across the machine frame. This results in a solid mounting of the guide bars which are depend from a so-called lapping bar shaft, to which they are connected to perform the lapping movement. The lapping bar shaft is connected at the lower end of the beam.

The warp knitting machines were equipped with a relatively small number of guide bars, for example, three as in the above-mentioned brochure. The pile instrument bar limits the space available for the guide bars and their arcuate movement and hinders incorporation of additional guide bars next to the pile instrument bar. Additional guide bars can be incorporated only using a correspondingly large extension in cross-section of the pile instrument bar with resulting increases in weight and mass.

SUMMARY OF THE INVENTION

It is amongst the objects of the invention to provide an improved warp knitting machine capable of incorporating a larger number of guide bars. It is amongst the objects of the invention to arrange the pile instrument bar so that a relatively compact pile instrument bar can be used.

The invention hence provides a warp knitting machine having a plurality of guide bars and a pile instrument bar characterized in that the pile instrument bar is off-set from the guide bar mounting below the operational zone of the guide bars. Suitably the pile instrument bar is movable lengthwise of the needle array. Preferably a sinker bar extends between a needle bar and completed fabric and has sinkers interdigitated with and extending rearwards of the needles for knock over. Advantageously the pile instruments are arranged above the sinkers and have a free end extending forward of the needles and, optionally, alongside the sinker bar. Preferably, the pile instruments extend individually in an arc upwards, alongside the needles and then downwards toward their free ends and the sinkers are short and lie substantially centrally of the pile instrument arc when seen in cross-section.

The pile instrument bar can be designed, using the location of the invention, to be of relatively limited cross-section and compactly shaped. In addition, space is made available for the provision and arcuate movement of a greater number of guide rows. For example, eight guide bars may be provided. A further advantage is that the guide instruments can be accessed from both sides of the needle array, permitting servicing and exchange of the guides from front or rear of the machine. The increased number of guide bars makes it possible to provide a wide pattern range of the pile loops.

BRIEF DESCRIPTION OF THE DRAWING

The FIGURE shows a section through a knitting head of an example of a warp knitting machine according to the invention.

DESCRIPTION OF A PREFERRED EMBODIMENT

The warp knitting machine has needles 1 with hooks arranged between knockover sinkers 3 mounted on a sinker bar 31 and closable in a known way by tongues or sliders 2 to provide compound needles mounted and actuated by bars 32 and 33. It is also possible to use self-operating latch needles instead of the separately actuated hooks and tongues of the compound needles. Eight guide bars 15 (of which only two are shown) with their guides 4, 5 and 8 are located above the knockover sinkers 3. The guides 4 and 5 in this example control warp yarn or threads 6 and 7 for a ground fabric 16 and the other guides 8 control pile yarns or threads 9 and 10 over pile instruments which are fixed to a pile instrument bar 12.

To form the pile loops, the guides 8 are lapped sideways across the pile instruments 11 in between being knitted into the ground fabric. The instruments 11 can be moved to control and vary the pile loop formation. The guides 4 and 5 merely cause the ground yarns to be lapped relative to the needles 1 to form ground fabric of tight stitches, knocked over by the sinkers 3 on lowering of the needles 1 in a closed condition.

The distribution of the warp yarns for the ground fabric and of the pile yarns can be varied as required. Pile loops 13 are anchored in known manner in the ground fabric 16. The pile instrument bar 12 is arranged below the uppermost working level of heads 14 of the needle hooks shown in dot-dash line 30 in the FIGURE that is to say below the zone in which the guides 4, 5 and 8 move arcuately about shaft 23 and transversely along axes of pins 28. The pile instrument bar 12 therefore lies in an area of the warp knitting machine which is devoid of guides 4, 5 and 8 so that a large number of guide bars, in this case eight, can be provided unproblematically.

The pile instrument bar 12 is secured to a pile instrument carrier 17, which is mounted slidably on pins 19 by means of cylindrical, linear ball bearings 18. The pins 19 are secured on a support 20, resting on a frame part 21 and no swinging movement is performed. The guide bars 15 are mounted by guide bar hangers 22 clamped in position in a known manner with respect to a swinging shaft 23 by a clamp 24. The shaft 23 is journalled in a bearing block 25 which is, in turn, secured under the transverse beam 26. The guide bars 15 are mounted slidable lengthwise in known manner by mens of pins 28 and cylindrical ball berings 27. For reasons of simplification, the mounting of the guide bars 15 is shown reduced and simplified with respect to the underlying part of the FIGURE, with guide clamps 29 shown interrupted in broken lines above and below.

What is claimed is:

1. In a warp knitting machine having a needle bar supporting a plurality of knitting needles which is supported for vertical reciprocal movement, means for opening and closing said needles as said needle bar reciprocates, a sinker bar having a plurality of sinkers for cooperating with said needles, a plurality of guide bars supporting a plurality of yarn guides mounted above said needle bar for swinging movement for guiding base and pile yarns about said needles, and a pile instrument bar having a plurality of pile forming instruments for forming pile loops, the improvement comprising:

(a) mounting means for supporting said pile instrument bar so that said pile loop forming instruments are located adjacent said needle bar while being offset from said yarn guide mounting means and below the zone of swinging guide bar movement.

2. In a warp knitting machine as set forth in claim 1, wherein means are provided for supporting said pile instrument bar within said mounting means for lateral movement along its longitudinal axis lengthwise of said knitting needles.

3. In a warp knitting machine as set forth in claim 1, wherein said sinker bar is supported so that said sinkers extend between said needle bar and a completed fabric takedown path so that said sinkers extend rearwardly with respect to said needles.

4. In a warp knitting machine as set forth in claim 3, wherein said pile forming instruments are disposed above the sinker level and have a free end extending forwardly with respect to the needles and in proximity to the sinker bar.

5. In a warp knitting machine as set forth in claim 1, wherein said pile forming instruments are arc-shaped and extend around a portion of said sinkers.

6. In a warp knitting machine as set forth in claim 1, which has at least four yarn guide bars.

7. A warp knitting machine comprising a needle bar having a plurality of knitting needles supported for vertical reciprocal movement, means for opening and closing said needles, a sinker bar having a plurality of sinkers for cooperating with said needles disposed between the needle bar and a fabric takedown path with said sinkers extending rearwardly and interdigitated with said knitting needles, a plurality of yarn guide bars, each of which has a plurality of yarn guides for guiding base and pile yarns about said needles, and a pile instrument bar having a plurality of pile forming instruments for forming pile loops, means for mounting said pile instrument bar for lateral sliding movement and actuating mens for controlling the sliding movement of said bar, said mounting means for said pile instrument bar being located to position said pile instrument bar adjacent said needle bar while being offset and below the zone of said swinging bar movement and supporting said pile forming instruments to operate above the sinker level, said pile forming instruments having a free end which extends forwardly with respect to said needles and in proximity to said sinker bar.

* * * * *